US007975325B2

(12) United States Patent
Holmstadt

(10) Patent No.: US 7,975,325 B2
(45) Date of Patent: Jul. 12, 2011

(54) PORTABLE TOILET

(75) Inventor: Ronald J. Holmstadt, Carver, MN (US)

(73) Assignee: Satellite Industries, Inc., Minneapolis, MN (US)

( * ) Notice: Subject to any disclaimer, the term of this patent is extended or adjusted under 35 U.S.C. 154(b) by 1227 days.

(21) Appl. No.: 11/544,529

(22) Filed: Oct. 6, 2006

(65) Prior Publication Data

US 2007/0163036 A1 Jul. 19, 2007

Related U.S. Application Data

(60) Provisional application No. 60/724,557, filed on Oct. 8, 2005.

(51) Int. Cl.
*A47K 11/02* (2006.01)

(52) U.S. Cl. ..... 4/449; 4/476; 52/79.1; 52/143

(58) Field of Classification Search ..... 4/449, 460, 4/476, 612, 613; 52/53, 79.1, 143
See application file for complete search history.

(56) References Cited

U.S. PATENT DOCUMENTS 6,327,719 B1 * 12/2001 Lobertmann et al. ..... 4/449
2004/0163335 A1 * 8/2004 Hampel ..... 52/143
* cited by examiner

*Primary Examiner* — Tuan N Nguyen
(74) *Attorney, Agent, or Firm* — Oppenheimer Wolff & Donnelly LLP

(57) ABSTRACT

A portable restroom is designed to provide features which enhance the comfort and appeal to users. These features include a rigid and stable structure, including a rigid floor structure, thus providing a sense of security to the user. Further, flushing and fresh water capabilities are achieved by using a dual tank structure made capable by the base design itself. This dual tank structure is achieved utilizing a unique siphoning pump to provide appropriate functionality.

11 Claims, 6 Drawing Sheets

PORTABLE TOILET

CROSS REFERENCE TO RELATED APPLICATIONS

This application claims the benefit of U.S. Provisional Application No. 60/724,557, filed Oct. 8, 2005.

BACKGROUND OF THE INVENTION

The present invention relates to a portable restroom. More specifically, the present invention relates to the floor structure of a portable restroom which includes unique supports to provide a more rigid floor, and which includes a unique water tank feature which provides a flushing capability for the restroom.

Portable restrooms are a widely used and very convenient part of today's society, providing facilities at many different locations when necessary. For example, these portable restrooms are often used at public events such as sporting events, outdoor concerts, public meetings, etc. In each of these applications, large groups of people are expected to attend, thus being overwhelming to any existing restroom facilities.

While the public clearly understands that the portable restrooms will not include the conveniences of home restrooms, it is still desirable to make these facilities as appealing and comfortable as possible. In this regard, several concerns include cleanliness, sufficient space to feel comfortable, and a sufficient structure so the user will experience a minimal level of privacy.

Along these lines, there are several mechanisms to provide these desired features. Initially, the structural integrity and strength of the portable restroom should be at a level where the user feels like they are in a strong and rigid structure, thus providing some feeling of security and comfort. Naturally, this must be balanced with the portable nature of the structure. Specifically, the structure must provide the desired solid/rigid feel, while also being light enough to be transportable. This creates a natural trade-off which must be balanced by the restroom manufacturer. While the strength of all components creating the structure are important, one obvious component that provides a concern has been the strength of the floor. More specifically, the floor in many prior art restrooms is somewhat flimsy and flexible, such that it will bow or flex when a user enters the restroom. When this occurs, immediate feedback is provided to the user, suggesting that the restroom is not extremely strong or rigid, thus inherently affecting their feeling of comfort.

In addition to the desired comfort and security, other features also affect the user's overall feeling of using portable restrooms. For example, features such as running water to provide hand washing capabilities, along with flushing mechanisms will provide a more comfortable and pleasing experience for the user. Naturally, adding these features or functions requires additional systems within the portable restroom, which complicates the overall product and adds to the cost/complexity involved in manufacturing. Thus, any design which efficiently adds these capabilities is very valuable.

In specifically considering the flushing feature, this requires a source of fresh water to be available within the portable restroom. Typically this requires an additional tank to hold flushing water, which is separate from the waste tank. As set forth in U.S. Pat. No. 6,327,719, assigned to the assignee of the present application, one possible location for this flushing water is within the restroom base itself. This requires that the base provide a source for appropriate reservoirs to contain this water designed into the particular component. That said, complications do exist related to the formation of a water holding tank within the base. Specifically, it is difficult to create a single tank which has inner-connected water ways and effectively utilizes all of the available area within the base unit. Further, when the portable restroom is utilized in unleveled locations, this single flushing tank becomes very problematic as available water will naturally migrate to a single side or edge of the base reservoir. Consequently, this single reservoir within the base unit is not completely ideal for all applications.

BRIEF SUMMARY OF THE INVENTION

In light of the complications outlined above, the present invention provides a portable restroom which has increased comfort for the user. More particularly, the present invention provides these comforts in part through the unique design of its base structure. This unique design provides two primary features that are incorporated into a single design. First, a dual water tank system is provided which effectively utilizes space contained within the runners of the base unit to provide flushing water to the portable restroom. More significantly, this dual tank capability is made feasible through the use of unique siphoning pump which draws water from each tank uniformly, while also having a self-leveling feature.

Secondly, the base unit of the present invention includes a ribbing structure, in a roto-molded product, which provides additional rigidity and strength to the floor. Consequently, when users enter the portable restroom of the present invention, the floor itself is rigid and solid feeling, thus providing a certain level of comfort to the user. This rigidity is achieved through an alternating structure of arched ribs, which bridge between pairs of primary beams in the floor structure itself. Consequently, the support points are evenly distributed throughout the floor resulting in a structure which more easily handles the desired loads. Additionally, the design is more easily fabricated using the desired roto-molding process because the material being molded efficiently fills the desired design. While the design itself provides additional support for the floor, the component functions much more efficiently (due to better formation when molded).

The above mentioned structure (i.e., primary beams and arched ribs) bridge between two supporting runners. The supporting runners sit on the ground (or other surface) to support the overall structure. This also provides an ability to move the restroom with a forklift.

As more fully discussed below, it is an object of the present invention to provide a portable restroom having a floor structure with significant rigidity so that users feel comfortable when entering the structure. This rigidity specifically provides a floor structure which does not bow or bend when walked upon by the user.

It is a further object of the present invention to provide a portable restroom having flushing capabilities. The flushing capability being made available due to a base design which incorporates a dual chamber reservoir capable of holding the necessary flushing water. This dual chamber reservoir cooperates with a uniquely designed siphon pump to provide for flushing capabilities along with a self-leveling feature.

BRIEF DESCRIPTION OF THE DRAWINGS

Further objects and advantages of the present invention will be seen by reading the following detailed description, in conjunction with the drawings in which.

DETAILED DESCRIPTION OF THE INVENTION

Certain features of the present invention are described below with regards to a preferred embodiment, as illustrated in the attached figures. Naturally, it will be understood by those skilled in the art, that certain variations and modifications could be made to this structure, without departing from the scope and spirit of the present invention.

Figure 1:
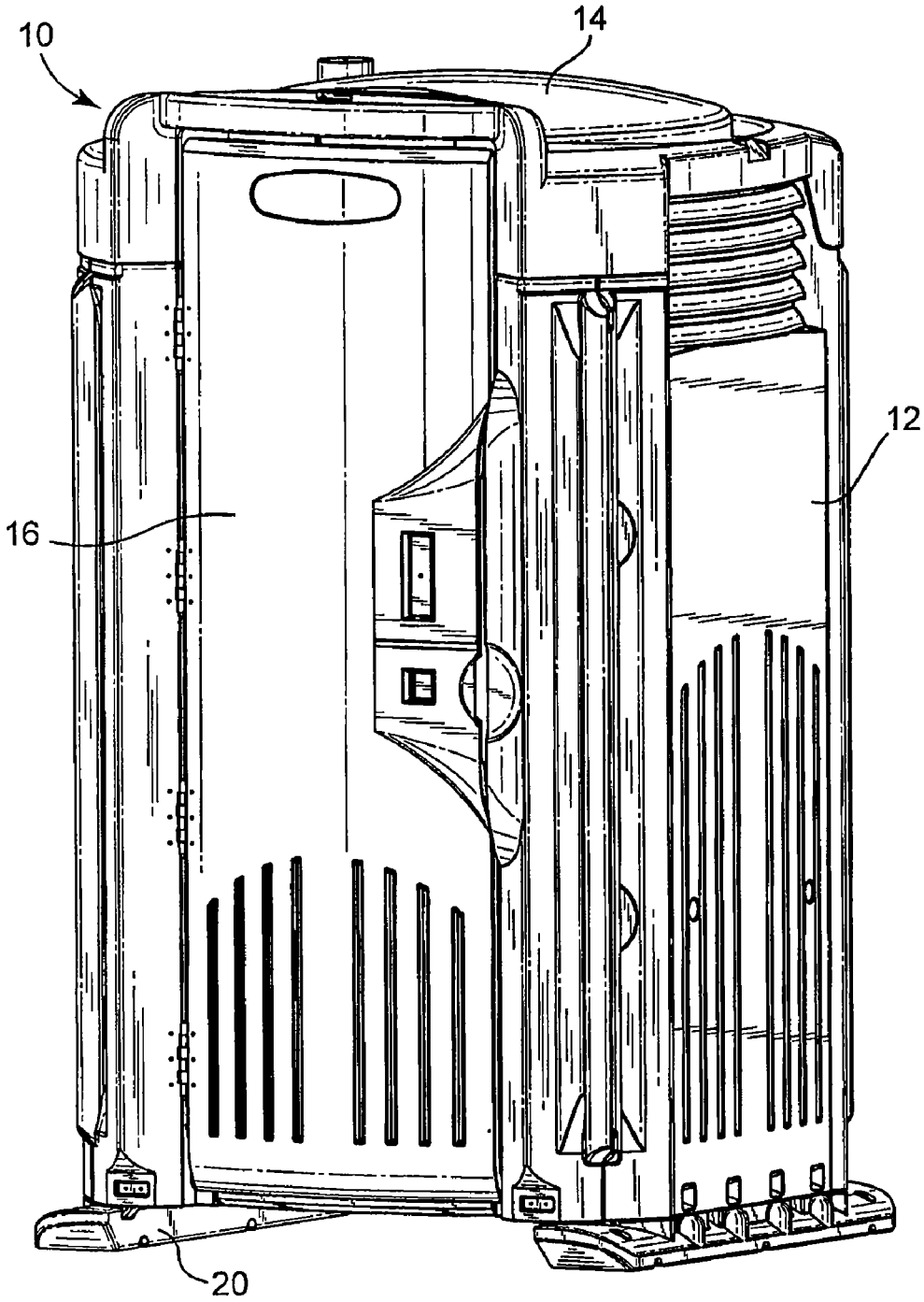
FIG. 1 is perspective view of one embodiment of the portable restroom of the present invention.

Referring now to FIG. 1, there is shown a perspective view of one embodiment of a portable restroom 10, having a restroom base 20, a plurality of exterior walls 12, a roof 14 and an enclosure door 16, all combined to create an enclosure for the portable restroom. Naturally, additional structures are contained within this enclosure to provide the necessary features, including a toilet structure having a waste tank of some type, potentially a urinal, appropriate tank venting, and air flow mechanisms (each of these features not shown in FIG. 1).

Figure 2:
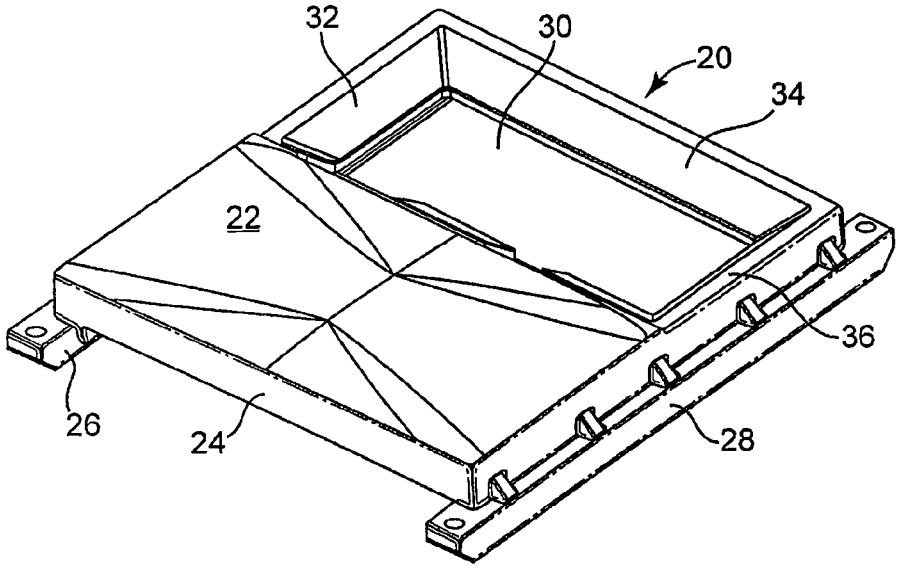
FIG. 2 is a perspective view of the base structure of the present invention.
Figure 3:
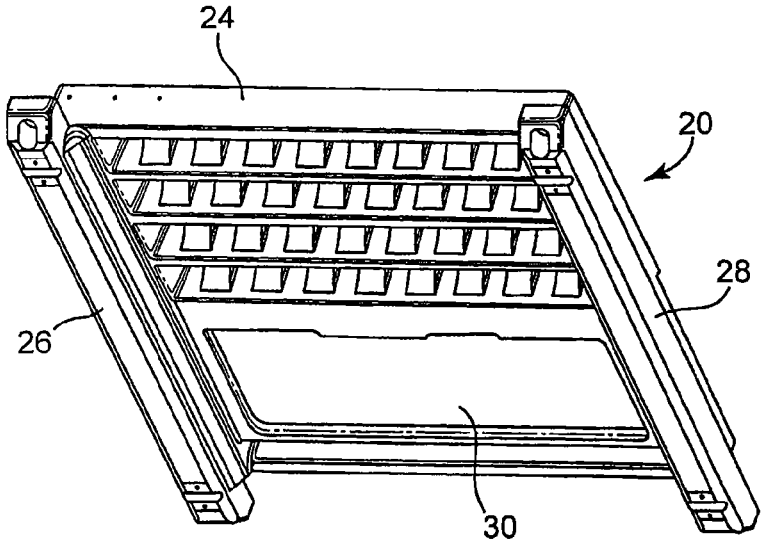
FIG. 3 is a perspective view illustrating the bottom of the base structure of the present invention.

Referring now to FIGS. 2 and 3, perspective views of the restroom base 20 are shown. As illustrated, FIG. 2 shows a top perspective view of restroom base 20, while FIG. 3 shows a bottom perspective view. As further illustrated, restroom base 20 includes a floor surface 22, a supporting structure 24, and a pair of supporting runners 26 and 28. As illustrated, supporting structure 24 bridges the area between first supporting runner 26 and second supporting runner 28, thus providing the necessary support for floor surface 22. Also illustrated is a waste tank recess 30 which is specifically configured to receive and support a toilet waste tank (not shown). Waste tank recess 30 is created by forming surround supports 32, 34 and 36. Specifically, left hand support 32 is situated on the left side of recess 30, rear support 34 is situated on the back side of recess 30, and right hand support 36 is situated on the right hand side of recess 30. Further, floor supporting structure 24 surrounds recess 30 on a front side, thus providing support on all four sides of recess 30.

In the preferred embodiment, the base structure is a single roto-modeled part, which is a single integral component. Further, restroom base 20 is configured to cooperate with the other components creating the enclosure, as generally illustrated in FIG. 1.

Figure 4:
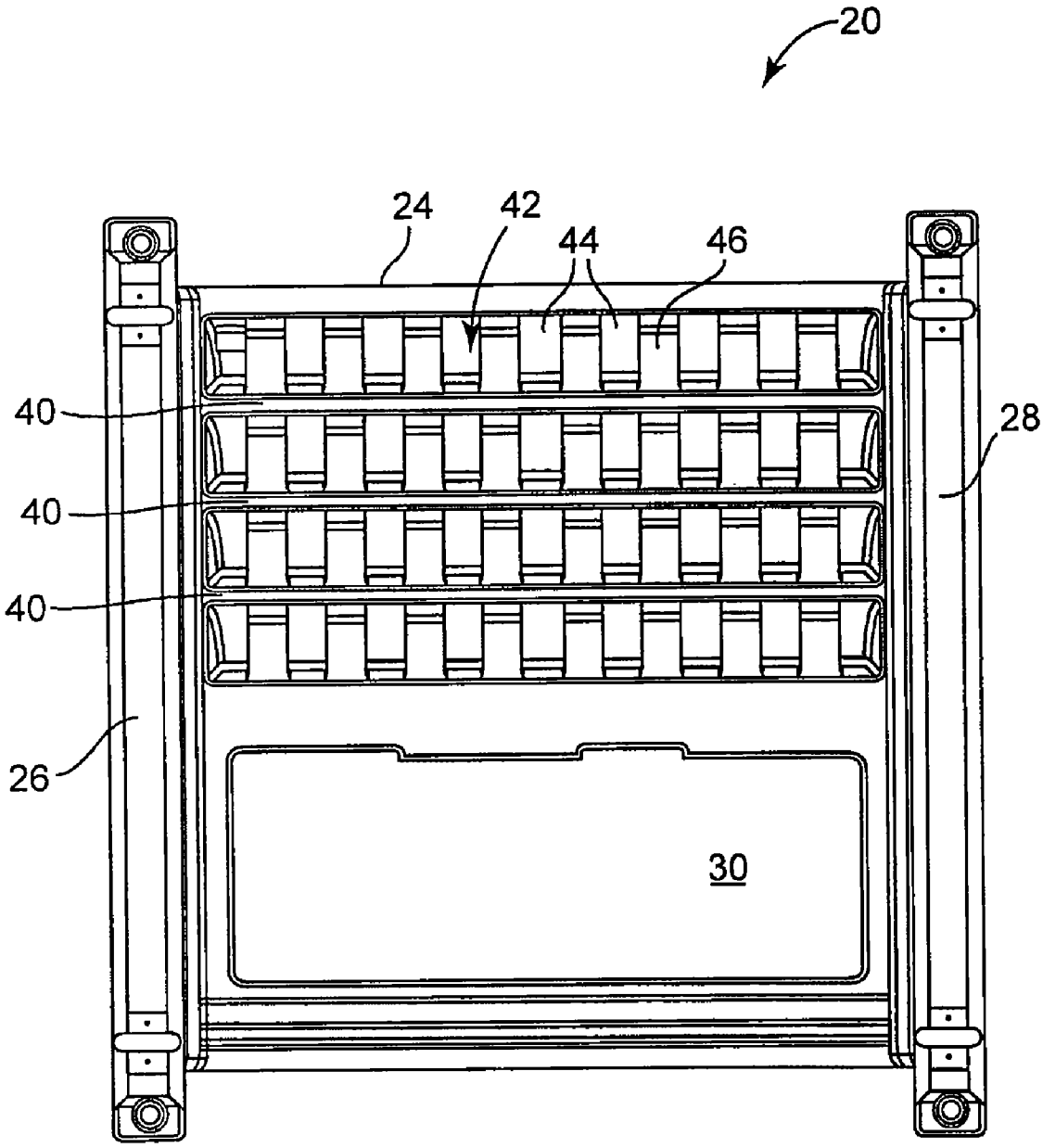
FIG. 4 is a bottom view of the base structure.
Figure 5:
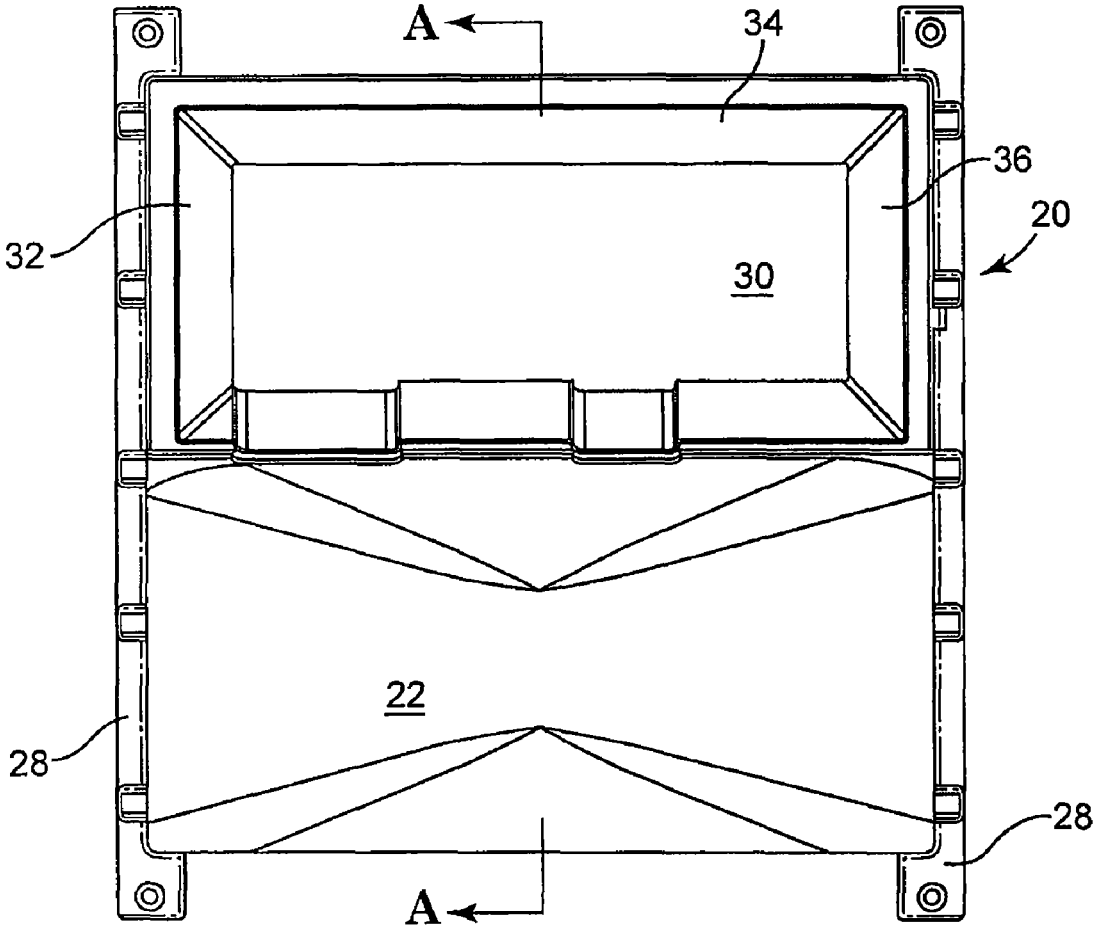
FIG. 5 is a top view of the base structure.

Referring now to FIG. 4, a bottom view of restroom base 20 is illustrated. More significantly, FIG. 4 provides additional detail regarding supporting structure 24 which provides an improved floor structure for the portable restroom of the present invention. As mentioned above, supporting structure 24 bridges the space between first runner 26 and second runner 28, thus providing a base framework upon which the remaining portion of the portable restroom can be formed. The supporting structure itself includes a number of main ribs 40 which are each molded into the bottom surface of restroom base 20. These main ribs 40 extend across the entire structure, and are configured somewhat consistently with conventional supporting ribs. Between each of the supporting ribs, a support web 42 exists, made up of a plurality of arched portions 44 which each extend upwardly to eventually contact an upper layer of floor structure 20.

Figure 7A:
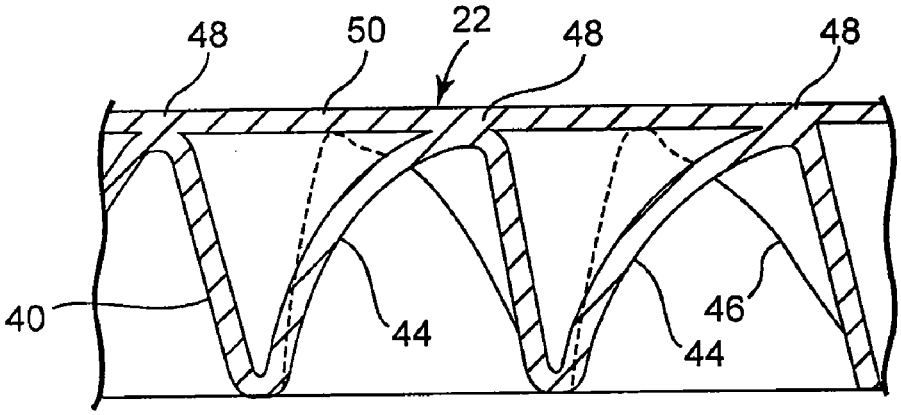
FIG. 7 is a cross-sectional view of the base structure illustrating the strengthening ribs.
Figure 6:
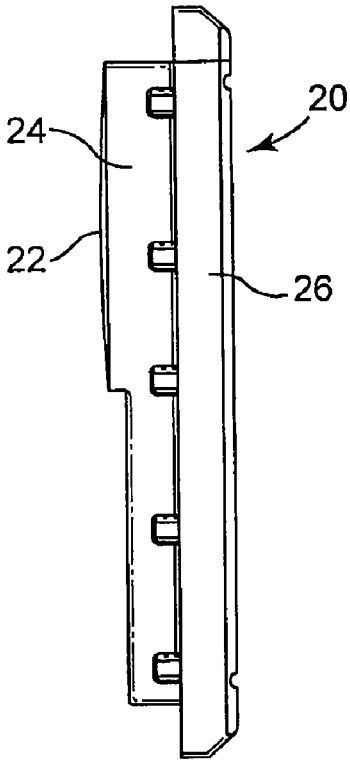
FIG. 6 is a side view of the base structure.
Figure 7:
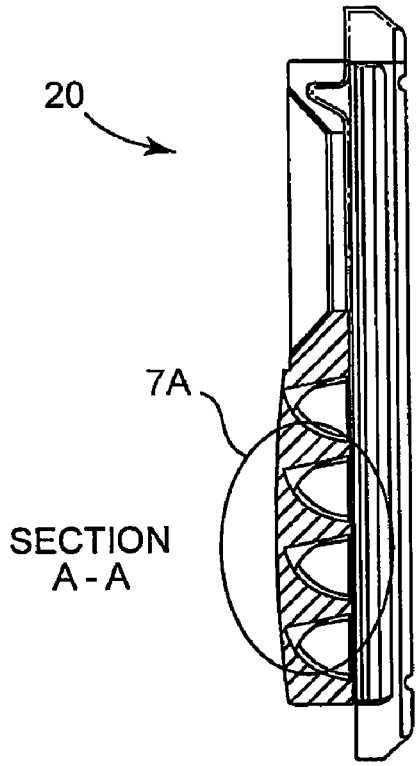

Referring now FIG. 7, a more detailed view of this supporting structure is illustrated. More specifically, FIG. 7 illustrates a cross-sectional view showing the plurality of arched portions 44 and their cooperation with supporting ribs 40. As more fully illustrated in FIG. 7A, which is an exploded view of cross-section FIG. 7, the arched portions 44 create a contact point 48 where material is joined with the portion supporting floor surface 22. Naturally, floor surface 22 is created from a panel of material 50. Floor surface material 50 is molded with or formed with arched portion 44 to provide a rigid contact point 48, as more fully illustrated in FIG. 7A. It will be appreciated by those skilled in the art, that a similar, oppositely facing arched portion 46 also exists, spaced away from arched portion 44, but creating a very similar structure. As illustrated in FIG. 4, arched portions 44 are illustrated in one row, while oppositely facing arched portions 46 are situated in adjacent rows. Consequently, the support web 42 is created which has multiple contact points evenly spaced to support floor surface 22.

Figure 8:
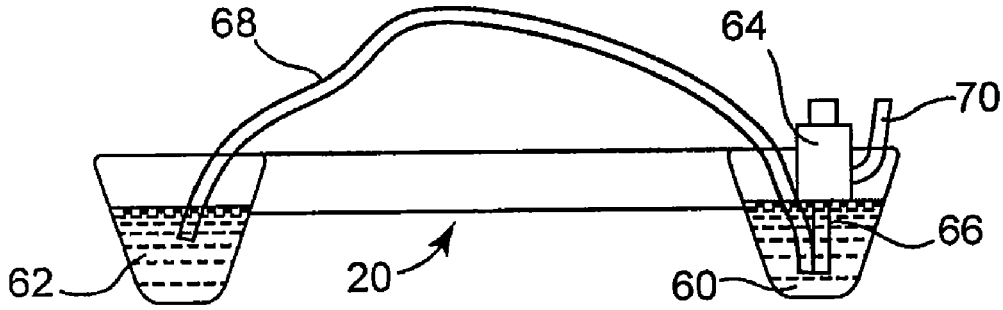
FIG. 8 is a schematic view illustrating the dual water tanks and unique siphoning pump of the present invention.

As also illustrated and suggested above, base structure 20 includes a first support runner 26 and a second support runner 28. Each of these support runners are configured to include an internal cavity 60, which easily will contain flushing water for use in a flushing application. More specifically, runners include a first internal cavity 60 and a second internal cavity 62, which are separate from one another due to molding and base configuration constraints. Referring to FIG. 8, this is schematically illustrated. In order to utilize these tanks for flushing capabilities, a pump 64 is incorporated which is operably connected to first internal cavity 60 and second internal cavity 62. The pump is functionally attached to first internal cavity 60 via an input hose 66. Further, pump 64 is connected to second internal cavity 62 via a second input hose 68. By operation of the pump, water can be provided to other systems via an output 70. Generally speaking, this system makes us of both internal cavities to effectively and efficiently store flushing water, while also meeting the structural needs of restroom base 20.

Figure 9:
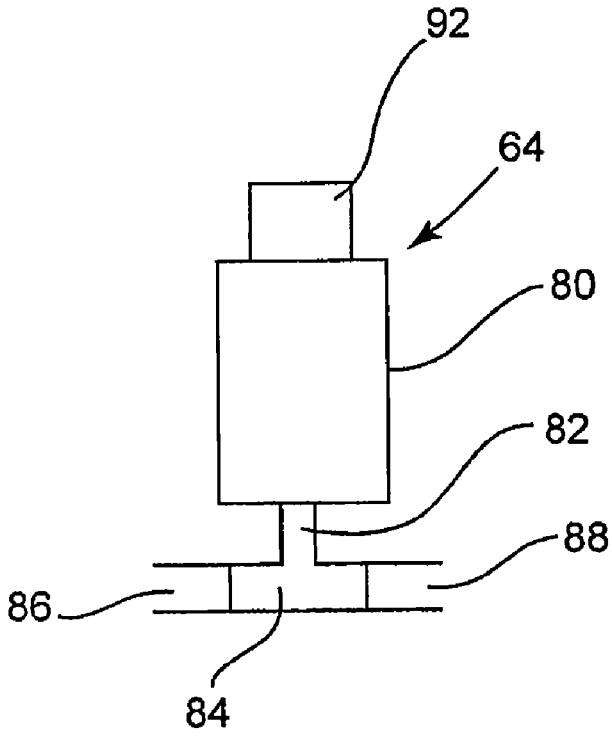
FIG. 9 is an exploded view illustrating the pump of the present invention.

In order to effectively achieve this dual tank pumping capability, the siphon pump of the present invention is uniquely designed. This design is more fully illustrated in FIG. 9, which shows a pump housing 80, having a pump inlet 82. Attached to pump inlet 82 is an inlet coupling 84, which provides the key to operating the dual reservoir pump system. Specifically, the input coupling 84 provides a self-leveling feature, while also allowing for water to be drawn from each particular reservoir. Input coupling 84 includes a first inlet 86 and second inlet 88 which are respectfully coupled to first input hose 66 and second input hose 68. A coupling outlet 90 allows water to be drawn from both reservoirs simultaneously by the siphon pump 64. Also, because input coupling 84 allows for free fluid flow between the two different reservoirs, self-leveling is achieved. More specifically, the water levels in the two particular reservoirs will maintain equal levels, throughout operation due to the natural ability of fluid flowing between these two reservoirs, and the existence of an initial vacuum in the system created when the pump is first operated.

While many different variations are possible, the pump in this embodiment is operated via a push button 92. The pump itself is typically mounted to the floor of base 20 so it is operable by the user's foot. Naturally, other variations are possible. Additionally, it is contemplated that the siphon pump 64 is used to provide flushing fluid to a flushing mechanism in the portable restroom. Such a flushing mechanism could be incorporated into a flushable toilet or a flushable urinal of various types. That said, the siphon pump 64 could also be used to provide water to a hand wash mechanism or sink of some type.

The present invention has now been described with reference to several embodiments. The foregoing detailed description and examples have been given for clarity of understanding only. Those skilled in the art will recognize that many changes can be made in the described embodiments without departing from the scope and spirit of the invention. Thus, the scope of the present invention should not be limited to the exact details and structures described herein, but rather by the appended claims and equivalents.

What is claimed is:

1. A uniform base structure creating a stable platform on an upper surface thereof capable of supporting the weight of individuals, the base structure comprising:

a bottom portion contacting a supporting surface in at least two locations;

a top panel forming the platform on an upper surface thereof; and a formed bottom panel bridging the at least two locations of the bottom portion contacting the support surface, the bottom panel having a plurality of primary ribs and a support web extending between the primary ribs, the support web extending upwardly such that an upper portion of the support web contacts a lower surface of the top panel, wherein the support web has a plurality of non-symmetrical arched portions extending generally parallel to one another between each pair of primary ribs and the top panel such that the arched portions are generally perpendicular to the primary ribs, each non-symmetrical arched portion extending only a longitudinal portion of the length of the primary rib, the plurality of non-symmetrical arched portions alternating in direction extending down the length of the primary rib, thus creating an alternating pattern of contact points with the top panel.

2. The base of claim 1 wherein the bottom portion includes a first runner and a second runner, and the bottom panel bridges an area between the first runner and the second runner.

3. The base of claim 1 wherein the bottom portion includes a first runner and a second runner, and wherein the first runner, second runner, top panel and bottom panel form a single molded component.

4. The base of claim 3 wherein the base is roto-molded.

5. The base of claim 3 wherein the first runner and second runner include a first reservoir and a second reservoir, respectively, internally molded to contain a liquid.

6. The base of claim 5 wherein the first reservoir and the second reservoir are isolated from one another such that fluid cannot flow there between.

7. The base of claim 1 wherein the support web further includes a plurality of substantially straight portions extending opposite the arched portions and providing a connection between the primary rib and the contact point on the side opposite the plurality of arched portions.

8. The base of claim 6 further comprising a flushing pump to provide flushing water to subsequent systems, the flushing pump in fluid contact with the first reservoir and the second reservoir.

9. A uniform base structure creating a stable platform on an upper surface thereof capable of supporting the weight of individuals, the base structure comprising:

a bottom portion contacting a supporting surface in at least two locations, the bottom portion having a first runner and a second runner that include a first reservoir and a second reservoir, respectively, internally molded to contain a liquid;

a top panel forming the platform on an upper surface thereof; and a formed bottom panel bridging the at least two locations of the bottom portion contacting the support surface, the bottom panel having a plurality of primary ribs and a support web extending between the primary ribs, the support web extending upwardly such that an upper portion of the support web contacts a lower surface of the top panel, wherein the support web has a plurality of non-symmetrical arched portions extending between each pair of primary ribs and the top panel, each non-symmetrical arched portion extending only a longitudinal portion of the length of the primary rib, the plurality of non-symmetrical arched portions alternating in direction extending down the length of the primary rib, thus creating an alternating pattern of contact points;

wherein the first runner, second runner, top panel and bottom panel form a single molded component.

10. The base of claim 9 wherein the first reservoir and the second reservoir are isolated from one another such that fluid cannot flow there between.

11. The base of claim 10 further comprising a flushing pump to provide flushing water to subsequent systems, the flushing pump in fluid contact with the first reservoir and the second reservoir.

* * * * *